US006676499B1

(12) United States Patent
Stewart, II

(10) Patent No.: US 6,676,499 B1
(45) Date of Patent: Jan. 13, 2004

(54) MALE/FEMALE ABRASIVE DISK/WHEEL MOUNTING MEMBER AND SUBSEQUENT ABRASIVE MOUNTING SYSTEMS

(76) Inventor: Joseph T. J. Stewart, II, 1420 E. Girard Pl., #437, Englewood, CO (US) 80110

( * ) Notice: Subject to any disclaimer, the term of this patent is extended or adjusted under 35 U.S.C. 154(b) by 0 days.

(21) Appl. No.: 10/200,936

(22) Filed: Jul. 23, 2002

Related U.S. Application Data

(60) Provisional application No. 60/307,116, filed on Jul. 23, 2001.

(51) Int. Cl.[7] ..... B24B 23/00

(52) U.S. Cl. ..... 451/359; 451/508; 451/509; 451/510; 451/511; 451/521

(58) Field of Search ..... 451/359, 508, 451/509, 510, 511, 521

(56) References Cited

U.S. PATENT DOCUMENTS

| | | | | |
|---|---|---|---|---|
| 571,066 | A | | 11/1896 | Ebert |
| 2,824,480 | A | | 2/1958 | Hotchkin |
| 2,996,851 | A | | 8/1961 | Gianatasio |
| 3,041,797 | A | | 7/1962 | Moffly |
| 3,046,709 | A | | 7/1962 | Cook |
| 3,082,582 | A | | 3/1963 | Jeske |
| 3,092,937 | A | | 6/1963 | Tocci-Guilbert |
| 3,119,208 | A | | 1/1964 | Gianatasio |
| 3,149,442 | A | | 9/1964 | MacKay et al. |
| 3,166,877 | A | * | 1/1965 | Reames ..... 451/510 |
| 3,270,467 | A | | 9/1966 | Block et al. |
| 3,307,300 | A | | 3/1967 | Field |
| 3,315,420 | A | | 4/1967 | Moberg |
| 3,340,652 | A | | 9/1967 | Purcell, Jr. |
| 3,344,787 | A | | 10/1967 | MacLean |
| 3,562,968 | A | | 2/1971 | Johnson et al. |
| 3,667,170 | A | | 6/1972 | MacKay, Jr. |
| 3,707,059 | A | | 12/1972 | Burtch et al. |
| 3,747,286 | A | | 7/1973 | Haigh |
| 3,808,753 | A | | 5/1974 | Maran |
| 4,245,438 | A | | 1/1981 | Van Buren, Jr. |
| 4,439,953 | A | | 4/1984 | Block et al. |
| 4,683,683 | A | * | 8/1987 | Block ..... 451/509 |
| 5,538,464 | A | * | 7/1996 | Mackay, Jr. ..... 451/342 |
| 5,823,862 | A | | 10/1998 | Heidelberger |

* cited by examiner

*Primary Examiner*—Joseph J. Hail, III
*Assistant Examiner*—Shantese McDonald
(74) *Attorney, Agent, or Firm*—Swanson & Bratschun, LLC

(57) ABSTRACT

An abrasive disk mounting system and a grinding system are provided. The mounting system permits both primary abrasive disks (typically having a diameter greater than about 5 inches) and secondary abrasive disks (typically having a diameter from about 1.5 inches to about 3 inches) to be mounted to the same backup pad and hub. Additionally, the mounting system permits abrasive disks to be secured with either male or female threaded mounting members, or with head caps or clips, to be mounted to the same backup pad and hub. The grinding system permits an abrasive disk or a backup pad extension to be quickly and easily secured to a hub.

10 Claims, 10 Drawing Sheets

MALE/FEMALE ABRASIVE DISK/WHEEL MOUNTING MEMBER AND SUBSEQUENT ABRASIVE MOUNTING SYSTEMS

RELATED APPLICATIONS

This application claims priority from U.S. Provisional Application Ser. No. 60/307,116, filed Jul. 23, 2001.

TECHNICAL FIELD

This invention relates to the field of abrasive grinding devices, and in particular to abrasive disk/wheel mounting members.

BACKGROUND ART

Abrasive disks are often used in stock removal, typically in two steps. A large abrasive disk, with a firm backup pad, is used first for primary stock removal. A much smaller disk, with a softer more contouring backup pad, is then used for final stock removal and a finished surface appearance. The primary disk is relatively large, generally larger than about 5 inches in diameter; an exemplary, commercially available primary disk 100 is illustrated in FIG. 1A. The primary disk is mounted to a drive unit (such as a handheld, air powered grinder, not illustrated) with a mounting bolt or a retaining nut which is either passed through a center-hole 102 in the primary disk 100 or affixed to a threaded bolt attached to the grinding machine and passed through the hole 102. The hole 102 is typically surrounded by a bushing 104 or other reinforcement. FIG. 1B illustrates one type of retaining member 106 having an opening which has internal (female) threads 108 to engage with an externally threaded (male) rod. FIG. 1C illustrates an alternative retaining member 110 which has external threads 112 to engage with an internally threaded opening.

The secondary disk is smaller than the primary disk, generally from about 1.5 to about 3 inches in diameter; exemplary, commercially available secondary disks 202, 212 and 222 are illustrated in FIGS. 2A–2C, respectively. A less commonly used secondary disk 232 is illustrated in FIG. 2D. The secondary disks 202, 212, 222 and 232 mount to the drive unit in several possible ways. Each includes a mounting member 204, 214, 224 and 234 secured to the respective secondary disk 202, 212, 222 and 232. The mounting member 204 of FIG. 2A includes an externally threaded bolt 206 secured within an opening of the mounting member 204. The mounting member 214 of FIG. 2B includes an internally threaded opening 216. The mounting member 224 of FIG. 2C includes an externally threaded rod 226 affixed thereto. And, the mounting member 234 of FIG. 2D includes two or more clips 236 affixed to the surface of the mounting member or formed as an integral part thereof.

Because of the different mounting schemes and the different sizes of the primary and secondary disks, primary and secondary disks are not directly interchangeable on the drive unit, nor are different secondary disks directly interchangeable. Therefore, in order to switch between two disks, an operator must remove a securing device, the mounted disk and the disk backup pad from a drive unit. The operator must then mount the subsequently larger/smaller backup pad and corresponding disk onto the drive unit and secure them. FIG. 3A is an exemplary prior art disk backup pad 302 to which the primary disk 100 may be mounted using an internally threaded mounting bolt 106 (FIG. 1B) to mate with an externally threaded rod 304. Additionally, the secondary disk 212 may also be mounted to the backup pad 302, again using the internally threaded mounting bolt 106, if the diameter of the backup pad 302 corresponds to the diameter of the secondary disk. FIG. 3B is an exemplary prior art disk backup pad 306 to which the primary disk 100 may be mounted using an externally threaded mounting bolt 110 (FIG. 1C). Additionally, the secondary disk 222 may also be mounted to the backup pad 306, again using the externally threaded mounting bolt 110, if the diameter of the backup pad 306 corresponds to the diameter of the secondary disk.

It would be desirable, therefore, to have a common disk mounting system suitable for use with both primary and secondary abrasive disks of various diameters and accommodating various mounting methods.

BRIEF SUMMARY OF THE INVENTION

An abrasive disk mounting system and a grinding system are provided. The mounting system permits both primary abrasive disks (typically having a diameter greater than about 5 inches) and secondary abrasive disks (typically having a diameter from about 1.5 inches to about 3 inches) to be mounted to the same backup pad and hub. Additionally, the mounting system permits abrasive disks to be secured with either a male or female threaded mounting member, or with clips or head caps, to be mounted to the same backup pad and hub. The grinding system permits an abrasive disk or a backup pad extension to be quickly and easily secured to a hub.

The grinding wheel mounting system of the present invention may be used with primary and secondary circular abrasive disks, the primary abrasive disks having diameters larger than the diameters of the secondary abrasive disks. The mounting system comprises a circular backup pad having a diameter approximately corresponding to a diameter of a secondary abrasive pad and having an opening centrally formed therein and a cylindrical hub secured within the opening of the backup pad. The hub comprises a first end having a first set of threads for securing the hub to a drive unit, and a second end having a face to which a grinding disk is mountable. The second end has a second set of threads internally formed therein, sized to receive male threads of a first type of mounting member to secure a grinding disk thereon, and a third set of externally formed threads, sized to receive female threads of a second type of mounting member to secure a grinding disk thereon.

The grinding system comprises a first abrasive disk having a plurality of equally angularly spaced head caps on a rear face thereof, a circular backup pad having a diameter approximately corresponding to a diameter of the first abrasive disk and having an opening centrally formed therein, and a cylindrical hub secured within the opening of the backup pad. The, hub comprises a first end having a first set of threads for securing the hub to a drive unit, and a second end having a plurality of equally angularly spaced recesses formed in the face sized and shaped to engage the head caps on the rear face of the first abrasive disk. Consequently, the first abrasive disk is mountable to the hub by causing the head caps to be engaged by the recesses in the second end of the hub.

DETAILED DESCRIPTION OF PREFERRED EMBODIMENT

Figure 1A:
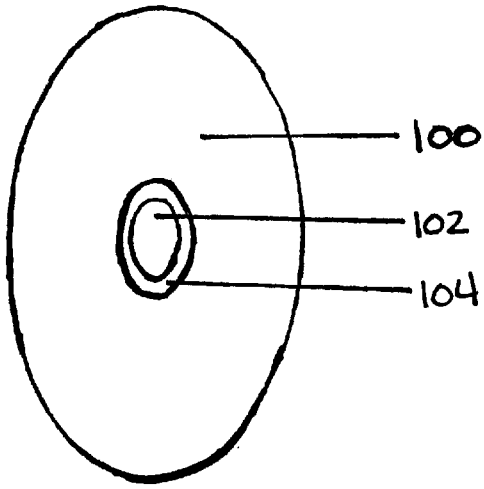
FIG. 1A illustrates an exemplary primary abrasive disk.
Figure 1B:
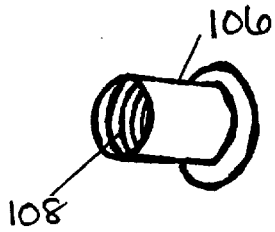
FIG. 1B illustrates a retaining member for the primary disk of FIG. 1A.
Figure 1C:
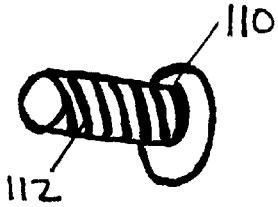
FIG. 1C illustrates an alternative retaining member for the primary disk of FIG. 1A.
Figure 4A:
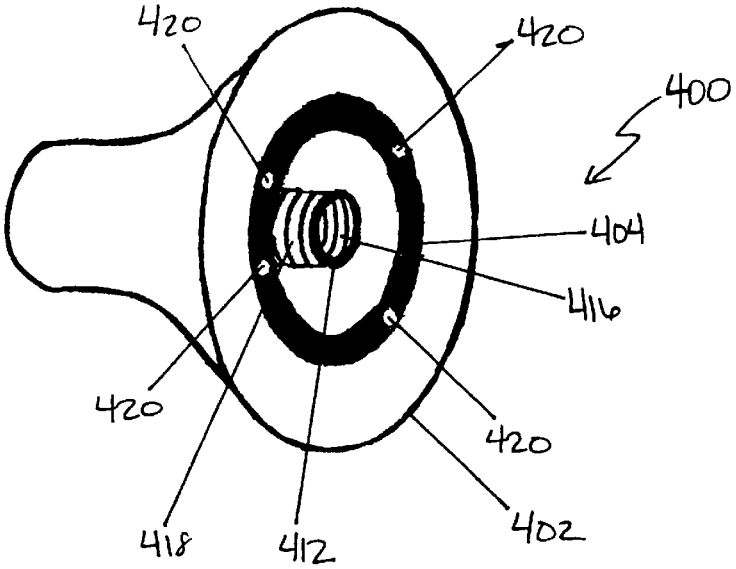
FIG. 4A is a front perspective of one embodiment of a mounting pad and hub of the present invention.
Figure 4B:
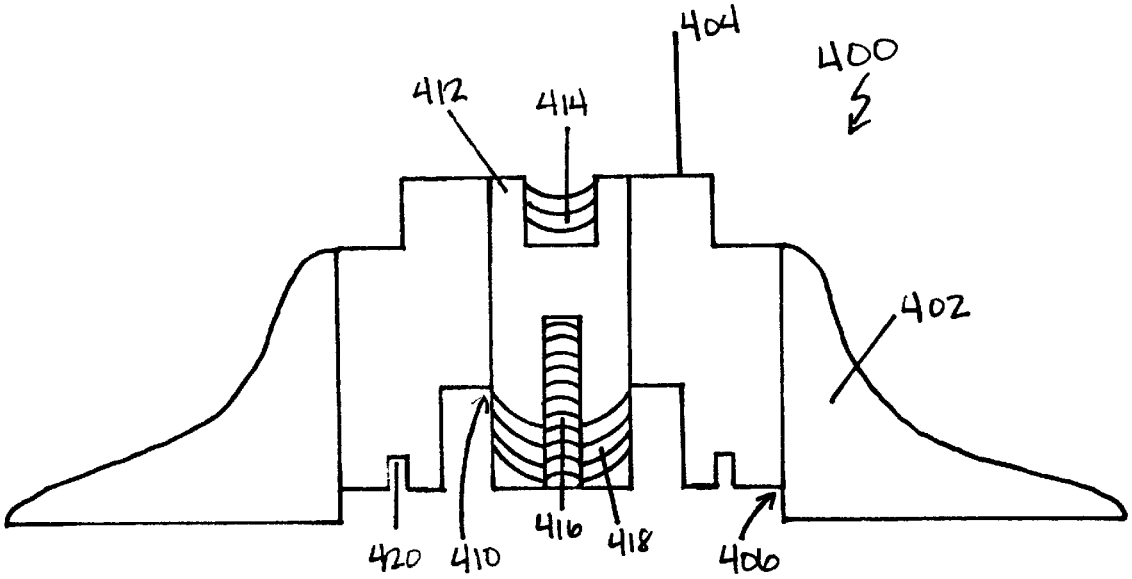
FIG. 4B is a cross-sectional view of the mounting pad and hub of FIG. 4A.

FIGS. 4A and 4B are a front perspective and cross-sectional view, respectively, of one embodiment 400 of a mounting or backup pad 402 and hub 404 of the present invention. The backup pad 402 is comprised of a resilient but not rigid compound adhered to the hub 404, which is metal or other suitable material. The backup pad 402 is curved and tapered to allow for flexibility and the ability to contour to the shape of the work piece to be ground. Preferably, the front of the hub 404 is inset relative to the front surface of the backup pad 404, thus creating a recess 406. The hub 404 is cylindrical with a hole formed through the center. The portion of the hub 404 where the front of the hole is located is further recessed 410 from the front of the hub 404. A rod 412, again preferably metal, is inserted and secured in the hole of the hub 404, such as by press-fitting or with an adhesive. The front of the rod 412 extends into the recess 410; the rear of the rod 412 is flush with the rear of the hub 404. In the embodiment illustrated in FIGS. 4A and 4B, the rear of the rod 412 is drilled and tapped with internal threads 414 to allow the backup pad 402 and hub 404 to be secured to a drive unit. The front of the rod 412 is also drilled and tapped with internal threads 416 to receive a mounting member such as the mounting member 110 illustrated in FIG. 1C. The front of the rod 412 also has external threads 418 formed thereon to receive a mounting member such as the mounting member 106 illustrated in FIG. 1B. The hub 404 also has holes or cavities 420 formed, milled or drilled therein. Existing secondary (or smaller primary) disks having configurations such as disks 202, 214 and 222 may be directly secured to the hub 404.

Figure 5A:
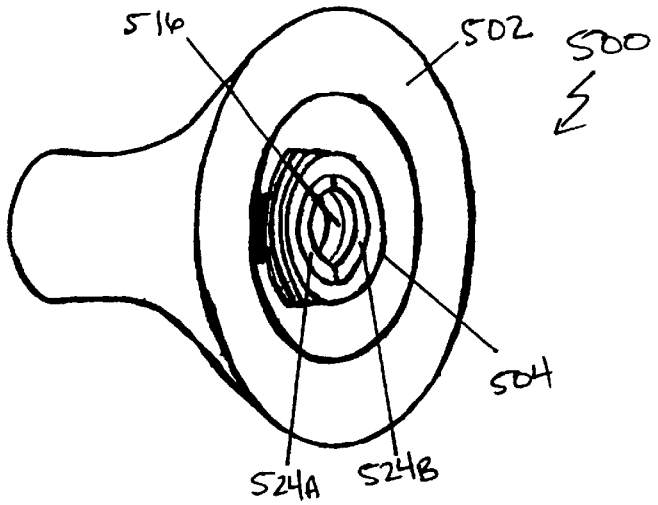
FIG. 5A is a front perspective of an alternative embodiment of a mounting pad and hub of the present invention.
Figure 5B:
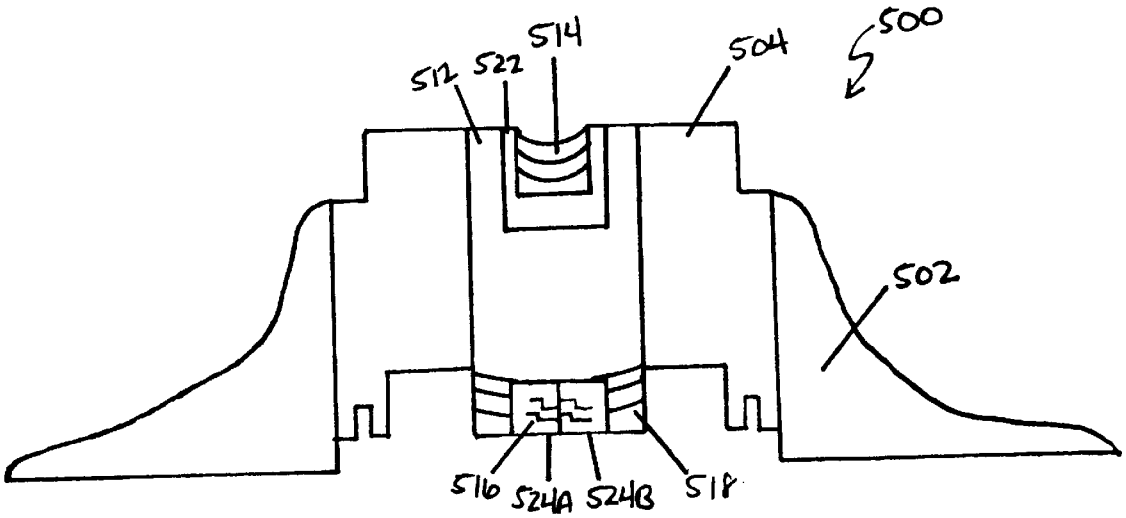
FIG. 5B is a cross-sectional view of the mounting pad and hub of FIG. 5A.

FIGS. 5A and 5B are a front perspective and cross-sectional view, respectively, of alternative embodiment 500 of a mounting or backup pad 502 and hub 504 of the present invention. For purposes of clarity, some of the elements of the hub and pad 500 which are in common with the hub and pad 400 have not been labeled. The backup pad 502 and hub 504 are similar to the backup pad 402 and hub 404 of the embodiment of FIGS. 4A and 4B. A rod 512 is similarly inserted and secured through the opening of the hub 504. The rear of the rod 512 has a cylindrical recess centrally drilled therein into which a cylindrical piece 522 may be press-fit or otherwise secured. The front of the rod 512 has an opening centrally drilled therein. Two threaded arcuate pieces 524A and 524B are press-fit or otherwise secured in the opening thereby creating internal threads 516. The front of the rod 512 also has external threads 518 formed thereon to receive a mounting member such as the mounting member 106 illustrated in FIG. 1B or the secondary disks 202 and 212 of FIGS. 2A and 2B. It will be appreciated that the method of providing internal threads 514 to the rear of the rod 512 may be exchanged for the method of providing internal threads 414 to the rear of the rod 412 and the method of providing internal threads 516 to the front of the rod 512 may be exchanged for the method of providing internal threads 416 to the front of the rod 412. It will also be appreciated that other methods of providing internal and external threads may be employed. Consequently, the present invention is not limited only to the methods and combinations illustrated.

Figure 6A:
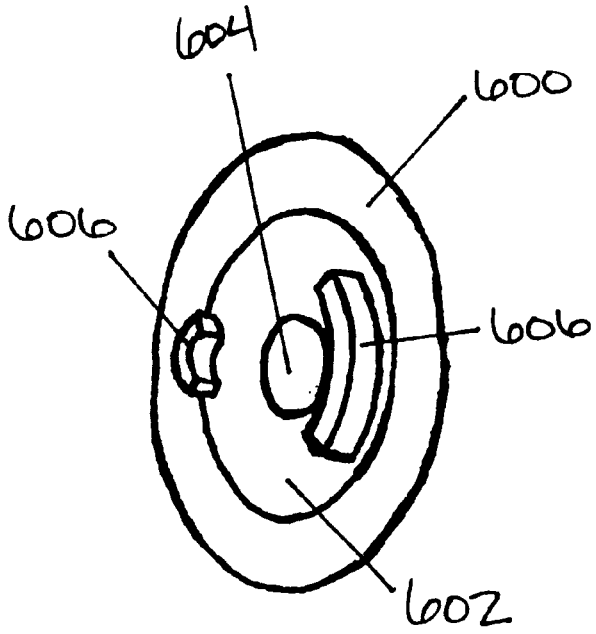
FIG. 6A is a rear perspective of one embodiment of a backup pad extension of the present invention.
Figure 6B:
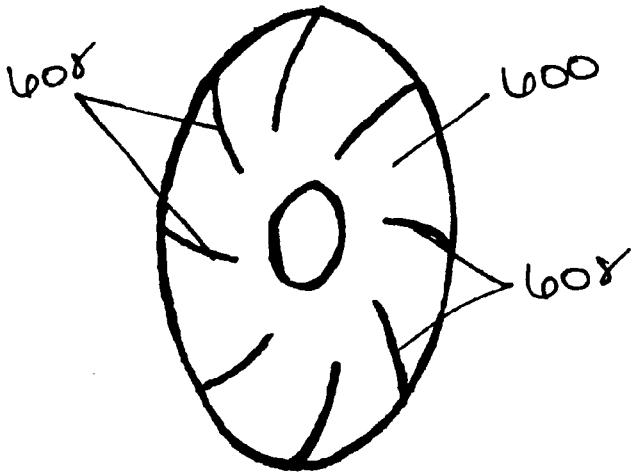
FIG. 6B is a front perspective of the backup pad extension of FIG. 6A.
Figure 7:
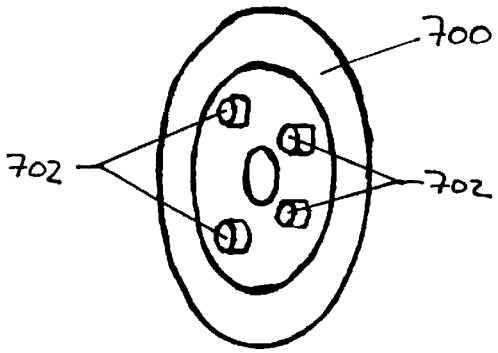
FIG. 7 is a rear perspective of an alternative embodiment of a backup pad extension of the present invention.

As previously noted, primary disks typically have a diameter greater than about 5 inches while secondary disk typically have a diameter from about 1.5 inches to about 3 inches. Consequently, primary disks require larger backup pads than secondary disks. In addition to providing a single backup pad and hub to accommodate the various mounting methods of both primary and secondary abrasive disks, the present invention also accommodates disks of various sizes. FIGS. 6A and 6B are rear and front perspectives, respectively, of a backup pad extension 600 of the present invention for use with the larger abrasive disks. The backup pad extension 600 is formed from a molded material that can be of varying firmness and is of an appropriate diameter to accommodate a primary or larger secondary disk. The backup pad extension 600 has a raised portion 602 that fits into the recess 406 between the hub 404 and the backup pad 402 in FIGS. 4A and 4B. A centrally located hole 604 surrounds the rod 412, but does not mount flush with the external threading 418 on the rod 412. The backup pad extension 600 is held in place on the backup pad and hub 400 by at least two equally angularly spaced brackets 606 molded, formed or otherwise a part of or secured to the rear face of the backup pad extension 600. The brackets 606 engage with the holes or cavities 420 of the backup pad and hub 400 and are press-fit manually for easy attachment/detachment. It will be appreciated that the brackets used to secure the backup pad extension may be other appropriate shapes. For example, FIG. 7 illustrates an alternative embodiment of a backup pad extension 700 on which circular brackets 702 are employed. Alternatively, the brackets may be of similar shape to the clips employed on the disk 232 of FIG. 2D to engage recesses 820 of the mounting pad and hub 800 illustrated in FIG. 8.

The front face of the backup pad extensions 600, 700 and 800 (to which the primary disk is affixed) may optionally include air-ventilation ribs 608 to help cool the abrasive disk and the operator to provide better performance and less operator fatigue.

Figure 2A:
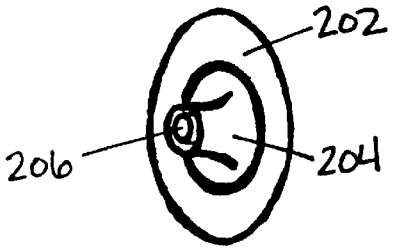
FIG. 2A illustrates a first secondary abrasive disk.
Figure 2B:
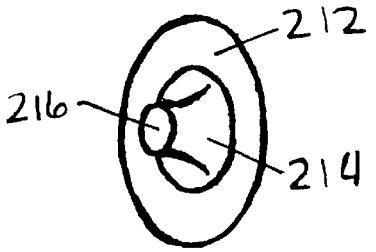
FIG. 2B illustrates a second exemplary secondary abrasive disk.
Figure 2C:
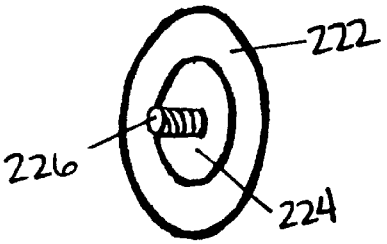
FIG. 2C illustrates a third exemplary secondary abrasive disk.
Figure 2D:
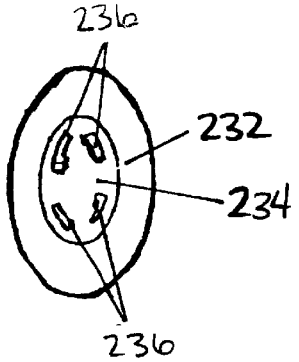
FIG. 2D illustrates a fourth exemplary secondary abrasive disk.
Figure 3A:
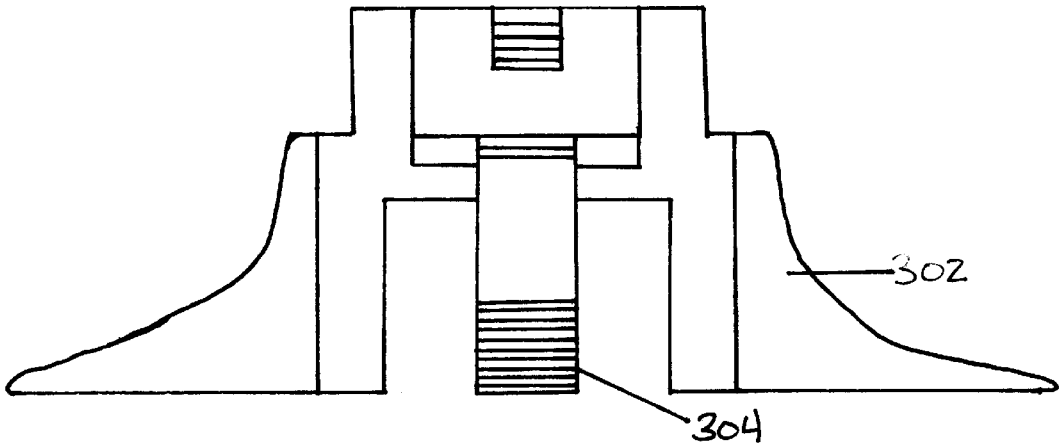
FIG. 3A (PRIOR ART)
FIG. 3A is a cross-sectional view of a first prior art mounting pad and hub.
Figure 3B:
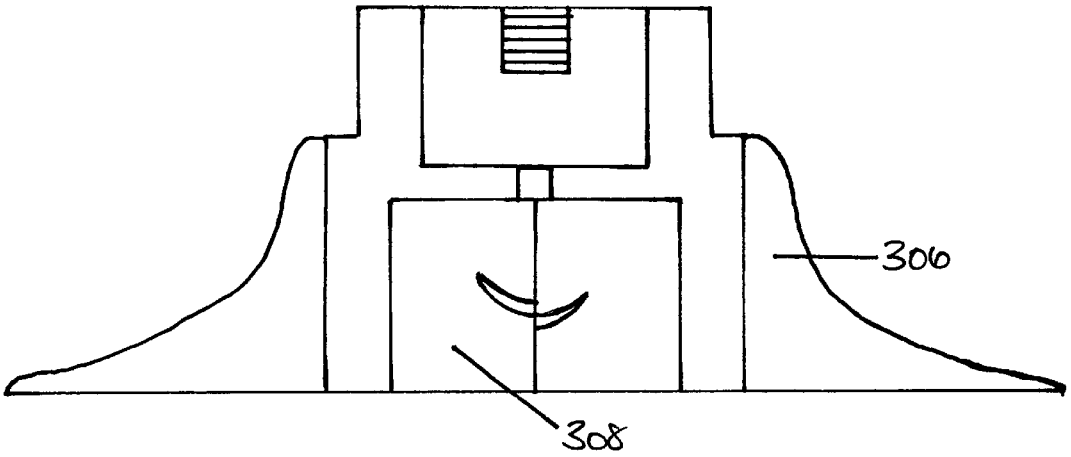
FIG. 3B (PRIOR ART)
FIG. 3B is a cross-sectional view of a second prior art mounting pad and hub.
Figure 8:
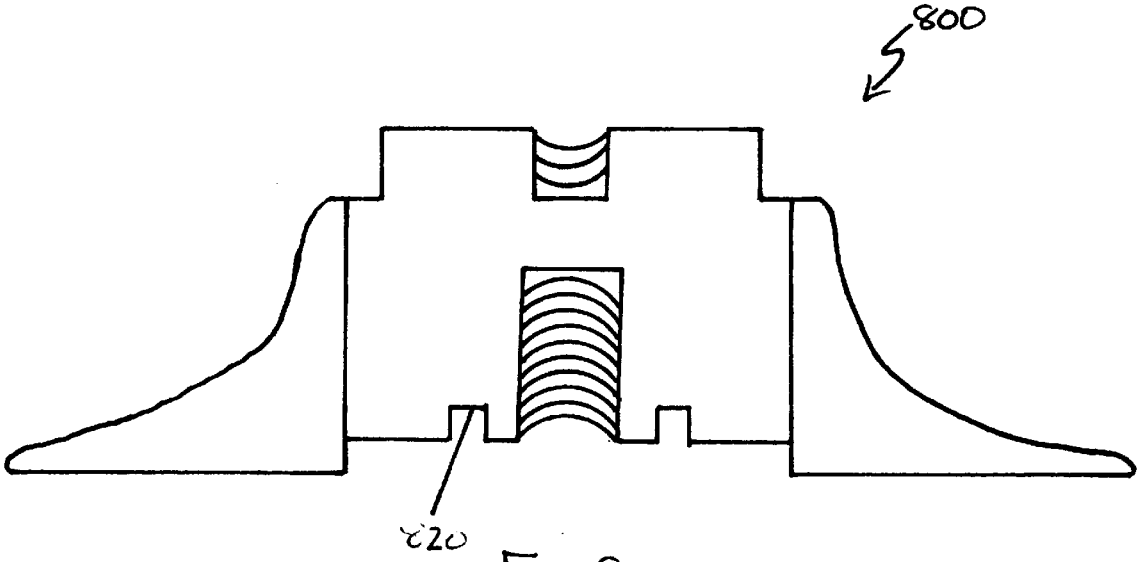
FIG. 8 is a cross-sectional view of another alternative embodiment of a mounting pad and hub of the present invention adapted to receive the abrasive disk of FIG. 2D.

FIG. 8, is a cross-sectional view of another alternative embodiment of a mounting pad and hub 800 of the present invention adapted to receive the less commonly used abrasive disk of FIG. 2D. Although similar to the mounting pads and hubs of FIGS. 4A, 4B, 5A and 5B, the hub 804 includes at least two equally angularly spaced recesses 820 shaped to receive the clips 204 of the disk 232 and thereby secure the disk 232 to the backup pad and hub 800.

Figure 9:
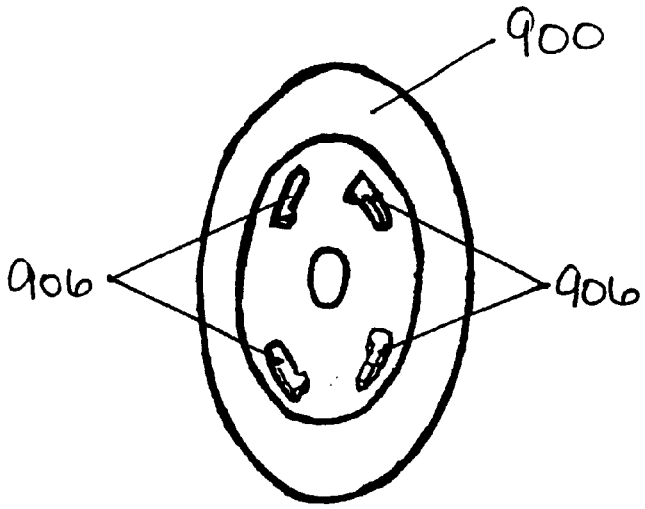
FIG. 9 is a rear perspective of another alternative embodiment of a backup pad extension for use with the mounting pad and hub of FIG. 8.

FIG. 9 is a rear perspective of another alternative embodiment of a backup pad extension 900 of the present invention used to secure a primary disk to the mounting pad and hub 800 of FIG. 8. The backup pad extension 900 includes at least two equally angularly spaced clips 906 shaped and sized to engage the recesses 820 in the backup pad and hub 800.

Figure 10:
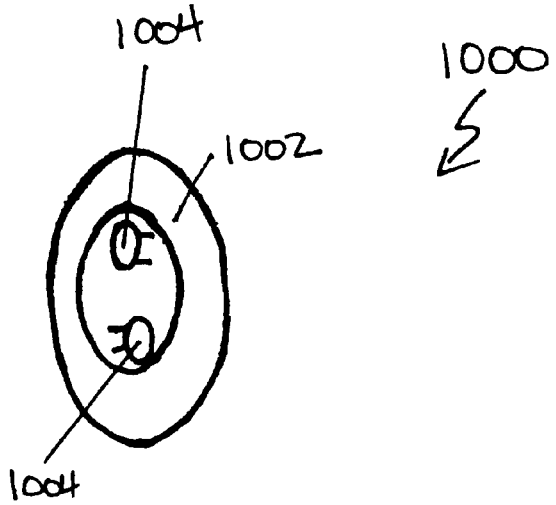
FIG. 10 illustrates a novel secondary disk of the present invention.

FIG. 10 illustrates a novel secondary abrasive disk 1000 of the present invention, including an abrasive disk 1002 and at least two equally angularly spaced head caps 1004 injection molded or formed by another process and glued or otherwise secured to or formed with the disk 1002. The head caps 1004 protrude on shafts beyond the rear surface of the disk 1002.

Figure 11A:
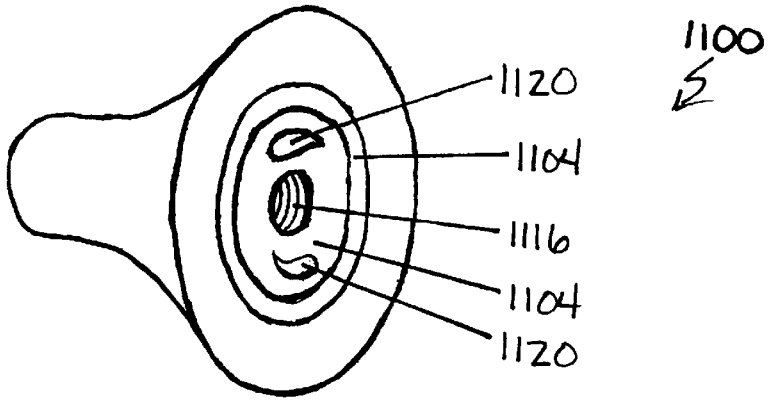
FIG. 11A is a front perspective of another alternative embodiment of a mounting pad and hub of the present invention for use with the secondary disk of FIG. 10.
Figure 11B:
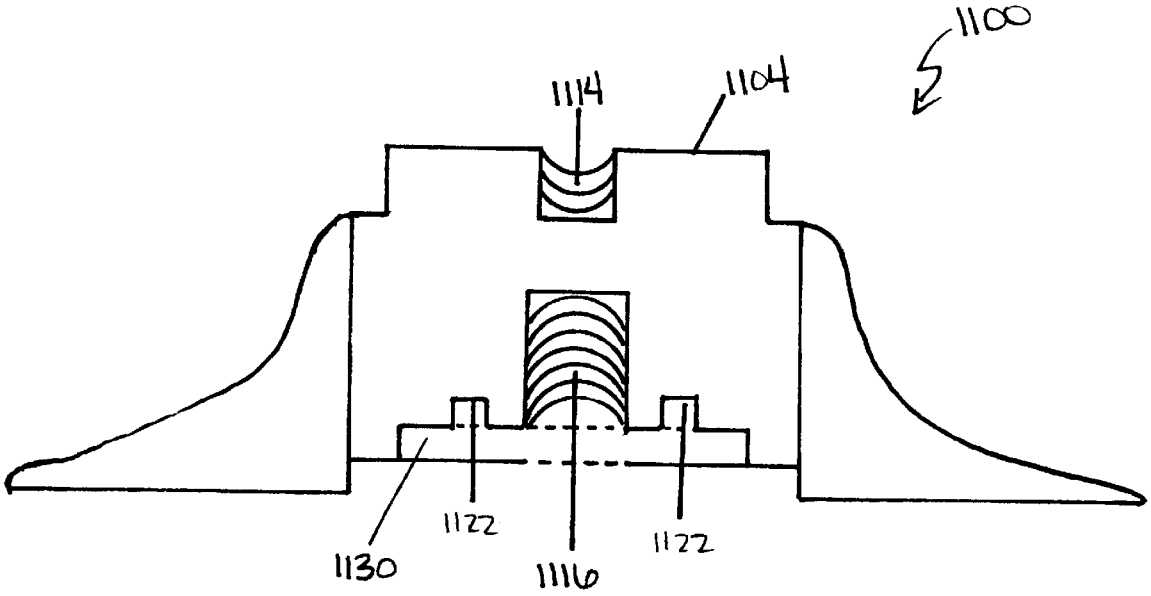
FIG. 11B is a cross-sectional view of the embodiment of the mounting pad and hub of FIG. 11A.

FIGS. 11A and 11B are front and rear perspectives, respectively of a backup pad and hub 1100 of the present invention. The rear surface of the hub 1104 is drilled and threaded with internal threads 1114 to permit the backup pad and hub 1100 to be secured to a drive unit. The front of the hub 1104 is drilled and tapped with internal threads 1116 to receive a mounting member such as the mounting member 110 illustrated in FIG. 1C. It will be appreciated that other methods of forming the internal threads 1114 and 1116 may be used, such as those described with respect to the backup pads and hubs illustrated in FIGS. 4A, 4B, 5A and 5B. A plate 1130 is press fit or otherwise secured within a recess in the face of the hub 1104, covering a deeper recess 1122. At least two equally angularly spaced openings 1120 through the plate 1130 are shaped and sized to receive the head caps 1004 of the disk 1000, which may be snapped through the openings 1120, thereby securing the disk 1000 to the backup pad and hub 1100. When the disk 1000 is rotated by the drive unit, centrifugal force causes the head caps 1004 to tighten against the perimeter of the openings 1120 and prevents the disk 1000 from falling off the backup pad and hub 1100. The plate 1130 also has a centrally located hole formed therethrough to allow a bolt to pass through and engage the threads 1116. The perimeter of the hole may also be threaded if desired.

Figure 12:
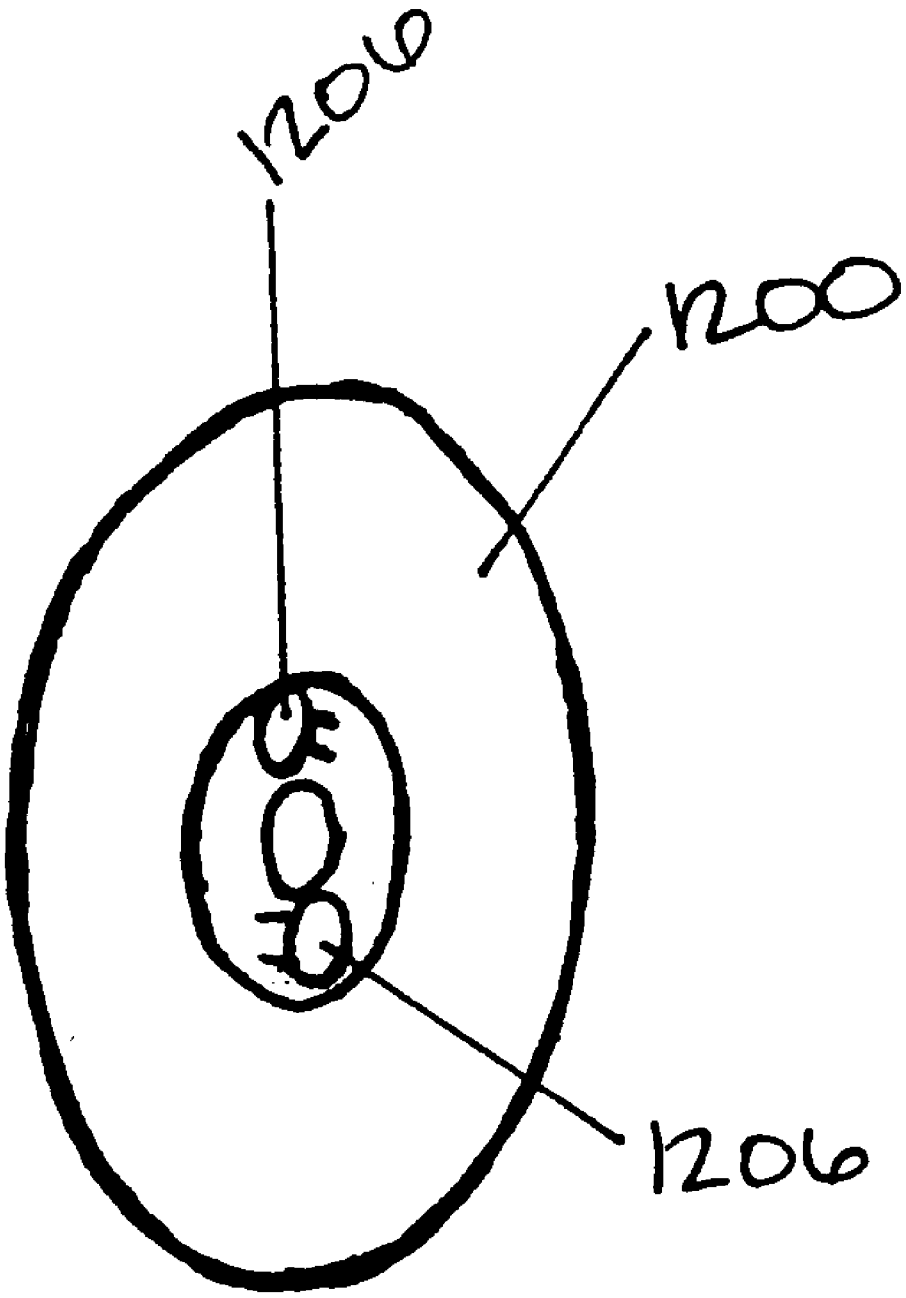
FIG. 12 is a rear perspective of a backup pad extension of the present invention for use with the primary disk of FIG. 1A and mounting pad and hub of FIGS. 11A and 11B.

In order to permit larger primary disks, having a conventional configuration, such as the disks 202 and 222 illustrated in FIGS. 2A and 2C, to be used with the backup pad and hub 1100, a backup pad extension 1200 is provided (FIG. 12). At least two equally angularly spaced head caps 1206 are formed in or secured to the front surface of the backup pad extension 1200 shaped and sized to snap into or otherwise engage the recesses 1120 of the backup pad and hub 1100, thereby securing the backup pad extension 1200 to the backup pad and hub 1100. A larger disk of the configuration of the disk 100 (FIG. 1A) may be secured to the hub 1104 by a conventional mounting member, such as mounting member 110 in FIG. 1C. A smaller disk of the configuration of the disk 222 (FIG. 2C) may be secured directly to the hub 1104 by screwing the mounting member 226 into the threads 1116 of the hub 1104.

When using the backup pads and hubs and backup pad extensions of the present invention, an operator may quickly, and efficiently alternate among different sizes and types of abrasive disks. Further, an organization may better track production performance by allocating one style of backup disk for each shift while only purchasing one hub style. The primary stock removal disk and backup pad extension may be substituted with a standard abrasive disk having either a built in bolt or a retaining member.

It will be appreciated that various combinations of the backup pads, hubs and backup pad extensions may be used and the foregoing descriptions should be not deemed as limiting. It will also be appreciated that other methods may be used to secure a backup pad extension to a hub. For example, the backup pad extension may be threaded to screw onto corresponding backup pads. Moreover, a backup pad may not be necessary when a backup pad extension is employed; the backup pad extension may be used with the hub alone.

What is claimed is:

1. A grinding wheel mounting system for use with primary and secondary circular abrasive disks, the primary abrasive disks having diameters larger than the diameters of the secondary abrasive disks, the mounting system comprising:

a circular backup pad having a diameter approximately corresponding to a diameter of a secondary abrasive pad; and a cylindrical hub operatively associated with said backup pad, said hub comprising:

a first end having a first set of threads for securing said hub to a drive unit; and a second end having a face to which a grinding disk is mountable, said second end having:

a second set of threads internally formed therein, sized to receive male threads of a first type of mounting member to secure a grinding disk thereon; and a third set of externally formed threads, sized to receive female threads of a second type of mounting member to secure a grinding disk thereon.

2. The system of claim 1, wherein:

said hub further comprises a plurality of equally angularly spaced recesses formed in said face; and said system further comprises a circular backup pad extension having:

a diameter approximately corresponding to a diameter of a primary abrasive disk;

a circular opening centrally formed therethrough; and a plurality of equally angularly spaced brackets sized and shaped to engage the recesses formed in said face of said hub;

whereby a primary disk is mountable to said hub and supported by said backup pad extension positioned therebetween.

3. The system of claim 1, said hub having a hole formed therethrough and further comprising a rod secured within the hole, said rod comprising:

a first end having the first set of threads;

a second end having the second set of threads internally formed within a central opening in said second end of said rod; and said second end further having the third set of threads externally formed thereon.

4. The system of claim 3, said rod further comprising first and second arcuate pieces secured within the second opening in said second end of said rod, said first and second arcuate pieces having the second set of threads formed therein.

5. A grinding system, comprising:

a first abrasive disk having a plurality of equally angularly spaced head caps on a rear face thereof;

a circular backup pad having a diameter approximately corresponding to a diameter of said first abrasive disk and having an opening centrally formed therein;

a cylindrical hub secured within the opening of said backup pad, said hub comprising:

a first end having a first set of threads for securing said hub to a drive unit;

a second end having:

a plurality of equally angularly spaced recesses formed in said rear face sized and shaped to engage the head caps on said rear face of said first abrasive disk; and a second set of threads internally formed within an opening formed therein, the second set of threads sized to receive male threads of a mounting member to secure a second abrasive disk to said hub; and a circular backup pad extension, having:

a diameter approximately corresponding to a diameter of a second abrasive disk, greater than the diameter of said first abrasive disk;

a circular opening centrally formed therethrough; and a plurality of equally angularly spaced head caps sized and shaped to engage the recesses formed in said second end of said hub;

whereby said first abrasive disk is mountable to said hub by causing said head caps to be engaged by the recesses in said second end of said hub;

whereby said backup pad extension is mountable to said hub by causing said head caps to be engaged by the recesses in said second end of said hub; and whereby the second disk is mountable to said hub and supported by said backup pad extension by causing the mounting member to be secured into the second set of threads with the backup pad extension positioned between said hub and the second disk.

6. A system for securing abrasive disks to a drive unit, comprising:

a hub mountable on the drive unit;

a first set of threads formed internally within a centrally formed opening in said hub and sized to receive male threads of a first type of mounting member for holding an abrasive disk of a first configuration to said hub; and a second set of threads formed on the outside of a cylindrical portion of said hub and sized to receive female threads of a second type of mounting member for holding an abrasive disk of a second configuration to said hub.

7. The system of claim 6, further comprising third means for holding an abrasive disk of a third configuration to said hub.

8. The system of claim 7, wherein:

said third means comprises a plate secured within a recess of said hub and having at least two equally angularly spaced openings therethrough, the openings sized and shaped to engage head caps on a rear face of the disk of the third configuration, wherein the disk of the third configuration is held to said hub.

9. The Asystem for securing abrasive disks to a drive unit, comprising:

a hub mountable on the drive unit;

a set of threads formed internally within a centrally formed opening in said hub and sized to receive male threads of a first type of mounting member to hold an abrasive disk of a first configuration to said hub; and a plate secured within a recess of said hub and having at least two equally angularly spaced openings therethrough, the openings sized and shaped to engage head caps on a rear face of an abrasive disk of a second configuration, wherein the abrasive disk of the second configuration is held to said hub.

10. The system of claim 9, further comprising a backup pad extension having at least two equally angularly spaced head caps on a rear face thereof for engagement within the openings through said plate, said backup pad extension comprising means for permitting an abrasive disk of the first configuration to be held to said hub with said backup pad extension being positioned therebetween.

* * * * *